US005868178A

United States Patent [19]

Lecointe

[11] Patent Number: 5,868,178

[45] Date of Patent: Feb. 9, 1999

[54] STRAW FOR STORING A BIOLOGICAL LIQUID, AND A METHOD OF FILLING IT

[75] Inventor: Pascal Xavier Lecointe, Quebriac, France

[73] Assignee: Eurl Cryo Vet, Tinteniac, France

[21] Appl. No.: 934,155

[22] Filed: Sep. 19, 1997

[30] Foreign Application Priority Data

Sep. 19, 1996 [FR] France ..... 96 11637

[51] Int. Cl.[6] ..... B65B 1/04

[52] U.S. Cl. ..... 141/110; 141/9; 141/59; 141/100; 141/312; 141/382; 119/174; 604/412; 604/905

[58] Field of Search ..... 141/130, 59, 65, 141/312, 329, 382, 100, 110, 9; 119/174; 604/411, 412, 413, 414, 415, 416, 905

[56] References Cited

U.S. PATENT DOCUMENTS 3,910,275 10/1975 Babey et al. ..... 128/234
5,249,610 10/1993 Cassou et al. ..... 141/30

*Primary Examiner*—David J. Walczak
*Assistant Examiner*—Timothy L. Maust
*Attorney, Agent, or Firm*—McCormick, Paulding & Huber

[57] ABSTRACT

A straw for storing a biological liquid such as animal semen, the straw comprising a fine tube open at both ends and closed by a plug engaged in one of said ends, said plug being formed by a powder suitable for transforming, on contact with the liquid, into a paste that is impermeable and leakproof, which powder is interposed between an external wad and an internal wad of a fiber material that is permeable to air and to liquids. The length of the external wad is at least twice as long as the length of the internal wad.

9 Claims, 1 Drawing Sheet

STRAW FOR STORING A BIOLOGICAL LIQUID, AND A METHOD OF FILLING IT

The present invention relates to a straw for storing a liquid biological substance, and to a method of filling it.

BACKGROUND OF THE INVENTION

A straw is constituted by a long narrow tube, used in particular in the field of artificial insemination, to receive a determined quantity of animal semen.

When supplied to users (insemination centers) for filling, these tubes generally have one of their ends closed. Depending on the application, the tube is filled with animal semen or with some other biological liquid such as viruses or an embryo in a liquid medium. After the other end of the straw has been closed by ultrasound welding or by any other technique known to the person skilled in the art, it is frozen for later use.

After being manufactured, straws are sterilized, generally by using gamma rays or by ionization, and they are packaged in sachets.

The straws most commonly in use have one end closed by a plug engaged inside the tube. The plug is generally constituted by a powder suitable for being transformed into a paste that is impermeable and leakproof. An example of material used is polyvinyl alcohol.

The powder is interposed between two wads of fiber material such as cotton. Such a material is selected to be permeable to liquids and to air. The wads are said to be external and internal, respectively.

For a straw of common type having a total length of 133 mm, the plug generally occupies a length of about 14 mm to 15 mm, with the remainder of the straw, referred to as the "working" volume, being intended to receive the biological liquid.

The method of filling such straws generally consists in applying suction to the end which is closed by the plug. To do this, said end is connected to a source of suction. A hollow needle connected to a source for feeding biological liquid, such as animal semen, is inserted into the other end.

In this way, the suction established through the permeable plug sucks the liquid into the straw. The liquid moistens the internal wad of the plug and also moistens the powder. The powder becomes progressively solid and impermeable.

Once the straw has been filled, it is closed. It can then be stored at very low temperature.

Nevertheless, implementing the above technique suffers from a drawback. After filling, and during unfreezing of the straw, a certain amount of expansion takes place, such that the external wad tends to move out of the tube. The straw must then be discarded since it cannot be used for insemination. It can even happen that on absorbing the liquid, the volume of the powder doubles, pushing away both the external wad and the internal wad, thereby reducing the working volume available for the liquid by a corresponding amount.

To mitigate that drawback, proposals have been made to interrupt the process of filling the straw only once a major portion of the external wad has soaked up the liquid. The wad then swells and deforms locally, thus opposing any tendency to move out of the tube.

Nevertheless, in spite of the precautions taken it sometimes happens that the wad does come out.

Further, by acting in that way, about 7% of the total volume of liquid inserted into the straw is retained in the plug and is therefore not usable, in particular for insemination purposes.

OBJECTS AND BRIEF SUMMARY OF THE INVENTION

The object of the present invention is to solve those problems.

In other words, the invention seeks to provide a straw of the same type as those commonly in use, but having a closure plug that is stable whatever the circumstances, i.e. a plug which remains in place even after the straw has been filled, frozen, and unfrozen.

The invention seeks simultaneously to reduce the volume of liquid that is used for moistening the plug, while keeping unchanged the working volume of the liquid required for storage, in particular for insemination purposes.

Finally, the invention seeks to achieve the above objects by means that are simple.

These objects are achieved by the present invention.

To do this, the invention proposes a straw for storing a biological liquid such as animal semen, the straw comprising a fine tube open at both ends and closed by a plug engaged in one of said ends, said plug being formed by a powder suitable for transforming, on contact with the liquid, into a paste that is impermeable and leakproof, which powder is interposed between an external wad and an internal wad of a fiber material that is permeable to air and to liquids.

According to the invention the length of the external wad is at least twice as long as the length of the internal wad.

Surprisingly, the Applicant has observed that under such conditions the plug, and in particular its external wad, remains in place whatever the circumstances. This may be due to the fact that the external wad presents sufficient inertia to oppose any displacement.

In addition, it is not necessary for the external wad to soak up liquid while the straw is being filled. As a result the volume of liquid inserted into the straw can be reduced by about 4%. In commercially available straws, 7% of the inserted volume has been soaked up by the plug.

According to other characteristics which are advantageous but not limiting:

- the length of the external wad is about three times as long as the length of the internal wad;
- the length of the external wad is about four times as long as the length of the internal wad;
- the length of the external wad is at least five times as long as the length of the internal wad;
- said powder is constituted by polyvinyl alcohol or by a complex of sodium alginate, calcium alginate, and calcium chloride;
- said fiber material is constituted by cotton, cotton wool, or polyamide;
- the diameter of the internal wad is greater than the diameter of the external wad; and
- said internal wad has a larger number of fibers than said external wad.

The invention also provides a method of filling such a straw with a biological liquid, in which the end of the straw that is closed by the plug is subjected to suction while said liquid is being admitted via the opposite end. The method is remarkable in that said suction is interrupted as soon as the liquid begins to be soaked up by said external wad.

BRIEF DESCRIPTION OF THE DRAWINGS

Other characteristics and advantages of the invention appear on reading the following detailed description of a preferred embodiment. The description is given with reference to the accompanying drawing, in which.

MORE DETAILED DESCRIPTION

Figure 1:
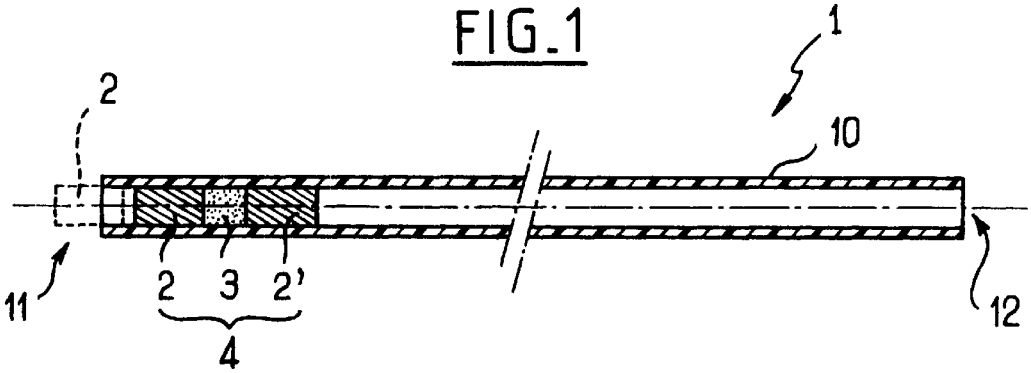
FIG. 1 is a longitudinal section view of an empty prior art straw intended for artificial insemination.

The prior art straw as shown in FIG. 1 is of a type commonly used for artificial insemination of cows.

It is in the form of a narrow hollow cylindrical tube 1, e.g. made of a plastics material that is flexible and transparent. By way of indication, the straw is 133 mm long and has an outside diameter of 1.95 mm. Straws of larger diameter, e.g. 2.85 mm, can also be used, but they do not always enable the liquid they are to contain to be frozen uniformly.

In a well known manner, the body 10 of the straw contains, close to one of its ends 11, a plug 4 constituted by a charge of polyvinyl alcohol powder 3 interposed between two thicknesses or wads of cotton 2 and 2'. Such a plug 4 is permeable to air. When the liquid to be stored in the straw comes into contact with the cotton 2', the cotton soaks up the liquid.

When the liquid reaches the powder 3, the powder solidifies, and the plug 4 becomes leakproof.

As is well known to the person skilled in the art, the plug performs two functions. Firstly it closes one of the ends of the full straw, and secondly it constitutes a piston for expelling the semen from the straw via the other end 12 during insemination.

As explained above, even though the cotton wad 2 is allowed to soak up the biological liquid filling the straw, it can happen that the wad projects from the tube 10.

This phenomenon is illustrated in FIG. 1 by the dashed-line position of the wad 2 where it extends in part from the end 11 of the straw.

Figure 2:
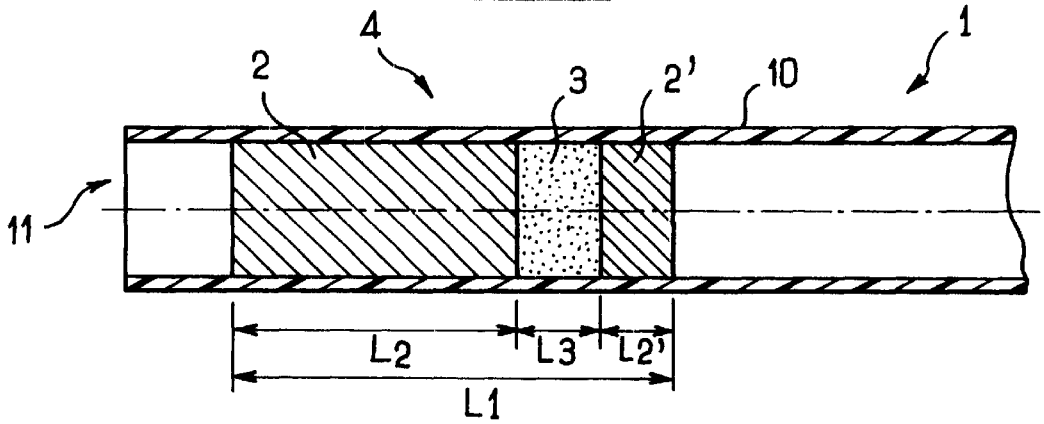
FIG. 2 is a fragmentary longitudinal view on a larger scale of a straw of the invention.

According to the invention, and as shown in FIG. 2, the straw 1 has an external wad 2 of length $L_2$ which is at least twice as long as the length $L_2$. of the internal wad 2'.

Nevertheless, in this case also, the plug 4 has the same three-part structure as a prior art plug, i.e. it has powder material 3 interposed between two wads 2 and 2'.

In particularly advantageous embodiments, the ratio $L_2/L_2$ is about three or four or is even greater than five.

It should be observed that the length $L_1$ which is the total length of the plug 4 can be identical to that of prior art straws, i.e. about 14 mm to 15 mm for a straw having a length of about 133 mm. As a result the working volume of the straw is kept unaltered.

By way of indication, $L_2$ can be about 9 mm while $L_3$ and $L_2$ are about 3 mm.

Before being inserted into the straw, the internal wad may be greater in diameter than the external wad. For this purpose, a greater number of fibers of cotton or of cotton wool or of polyamide are used, e.g. 36 instead of 27.

When the wad is inserted into the straw after it has been compressed, the fibers are pressed very tight against one another. The wad then constitutes a filter through which sperm cannot pass when the liquid is semen. This results in an increase in the concentration of sperm in the straw, thereby improving the fertilization rate on subsequent insemination.

In addition, the wad is mechanically stronger, which prevents it from moving easily when the powder 3 swells.

Such a straw can be filled using the technique that is most widespread at present.

Figure 3:
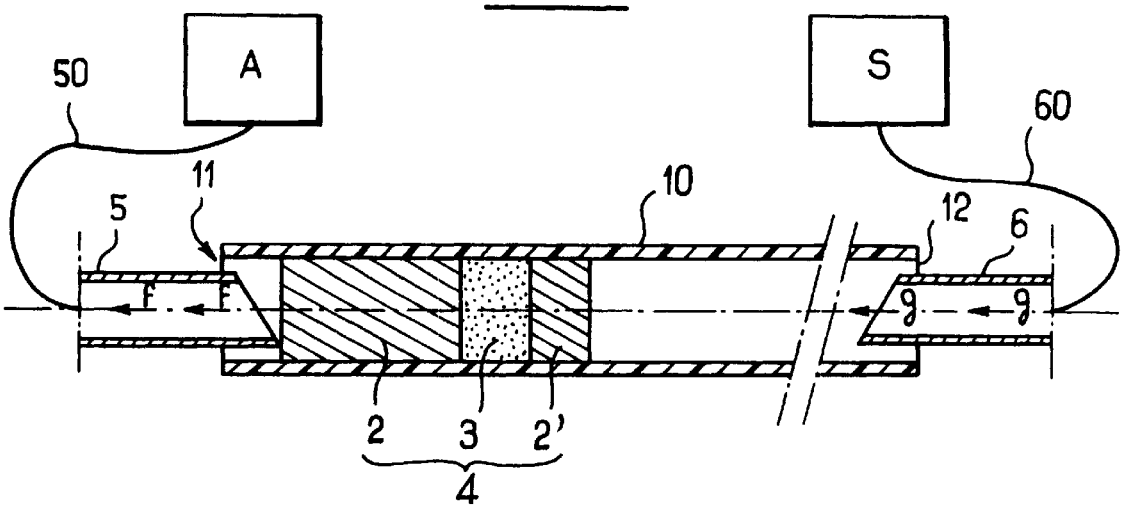
FIG. 3 is a theoretical diagram showing how the FIG. 2 straw is filled.

This technique is explained below with reference to FIG. 3, assuming that the biological liquid to be put into place is animal semen, e.g. bull semen.

The means used for filling comprise a suction source A, e.g. a pump, connected to a hose 50 with a hollow needle 5 fixed to the end thereof. The means also comprise a receptacle S containing the semen, which is likewise connected via a hose 60 to a hollow needle 6.

The needles 5 and 6 are inserted into respective ends 11 and 12 of the straw to be filled.

The suction source A is put into operation and a valve (not shown) fitted to the receptacle S is opened so as to allow semen to be sucked into the straw.

Because the plug 4 is permeable to air, a suction flow is established in the straw in the direction of arrows f, thereby lowering the pressure in the vicinity of the needle 6.

This makes it easy to fill the straw with semen, which flows in the direction of arrows g.

On contact with the semen, after it has been soaked up by the cotton wad 2', the grains of polyvinyl alcohol 3 solidify to form a liquid-tight paste.

When the diameter of the internal wad 2' prior to insertion into the straw is greater than the diameter of the external wad, then the internal wad brakes the inertia of the liquid during filling. Less powder is therefore required to stop suction. Thus, a smaller quantity of liquid is soaked up which means that there is a greater working quantity of semen in the straw.

After filling, the second end 12 of the straw is closed, e.g. by ultrasound treatment using a technique that is well known.

After the straw has been frozen and subsequently unfrozen for the purpose of performing artificial insemination, the entire plug 4 remains in place, i.e. the wads 2 and 2' do not move and never move out from the straw. This surprising result is obtained even if suction is switched off while the straw is being filled as soon as the semen begins to be soaked up by the wad 2. This is particularly advantageous since it makes a 4% volume saving of semen possible with the most commonly available 133 mm straws.

As an indication, a bull ejaculate makes it possible to fill about 520 133 mm straws of the invention compared with 500 prior art straws. For an average unit sale price of about US$ 30, that represents an increase of US$ 600 per ejaculate.

What is claimed is:

1. A straw for storing a biological liquid such as animal semen, the straw comprising a fine tube open at both ends and closed by a plug engaged in one of said ends, said plug being formed by a powder suitable for transforming, on contact with the liquid, into a paste that is impermeable and leakproof, which powder is interposed between an external wad and an internal wad of a fiber material that is permeable to air and to liquids, wherein the length of the external wad is at least twice as long as the length of the internal wad.

2. A straw according to claim 1, wherein the length of the external wad is about three times as great as the length of the internal wad.

3. A straw according to claim 1, wherein the length of the external wad is about four times as great as the length of the internal wad.

4. A straw according to claim 1, wherein the length of the external wad is at least five times as great as the length of the internal wad.

5. A straw according to claim 1, wherein said powder is constituted by polyvinyl alcohol or by a complex of sodium alginate, calcium alginate, and calcium chloride.

6. A straw according to claim 1, wherein said fiber material is constituted by cotton, cotton wool, or polyamide.

7. A straw according to claim 1, wherein, prior to insertion in the straw, the diameter of the internal wad is greater than the diameter of the external wad.

8. A straw according to claim 6, wherein, prior to insertion in the straw, the diameter of the internal wad is greater than the diameter of the external wad, and wherein said internal wad has a larger number of fibers than said external wad.

9. A method of filling a straw according to claim 1 with a biological liquid, in which the end of the straw that is closed by the plug is subjected to suction while said liquid is being admitted via the opposite end, and wherein said suction is interrupted as soon as the liquid begins to be soaked up by said external wad.

* * * * *